United States Patent [19]

Olsen

[11] 4,313,570

[45] Feb. 2, 1982

[54] HIGH PRESSURE CUTTING NOZZLE WITH ON-OFF CAPABILITY

[75] Inventor: John H. Olsen, Vashon, Wash.

[73] Assignee: Flow Industries, Inc., Kent, Wash.

[21] Appl. No.: 96,219

[22] Filed: Nov. 20, 1979

[51] Int. Cl.[3] ..... B05B 1/02; E21B 7/18

[52] U.S. Cl. ..... 239/583; 175/422; 239/590.5; 239/596; 251/61.5

[58] Field of Search ..... 239/533.15, 569, 570, 239/583, 590.5, 591, 596, 600; 83/22, 53, 177; 299/17; 175/67, 422; 251/61.5, 63.4, 333

[56] References Cited

U.S. PATENT DOCUMENTS

| | | | |
|---|---|---|---|
| 1,271,898 | 7/1918 | Holt | 251/333 |
| 1,710,055 | 4/1929 | Grant . | |
| 2,674,261 | 4/1954 | Wilson | 137/498 |
| 2,969,926 | 1/1961 | Peeps | 239/570 X |
| 3,087,510 | 4/1963 | Normand, Jr. | 137/509 |
| 3,106,169 | 10/1963 | Prosser et al. | |
| 3,309,013 | 3/1967 | Bauer . | |
| 3,309,014 | 3/1967 | Bauer et al. | |
| 3,410,304 | 11/1968 | Paul, Jr. | 251/63.4 X |
| 3,526,246 | 9/1970 | Leitgeb | 137/512.3 |
| 3,645,346 | 2/1972 | Miller et al. | 175/422 X |
| 3,659,967 | 5/1972 | McArthur et al. | 417/397 |
| 3,704,833 | 12/1972 | Wheat | 239/585 |
| 3,705,693 | 12/1972 | Franz | 239/600 |
| 3,927,723 | 12/1975 | Hall et al. | 175/422 |
| 3,997,111 | 12/1976 | Thomas et al. | 239/596 X |
| 4,026,322 | 5/1977 | Thomas | 251/333 X |
| 4,054,156 | 10/1977 | Benson | 137/630.12 |
| 4,162,763 | 7/1979 | Higgins | 175/422 X |
| 4,175,585 | 11/1979 | Boehme | 137/509 |

FOREIGN PATENT DOCUMENTS

| | | | |
|---|---|---|---|
| 1425466 | 2/1976 | United Kingdom | 83/177 |

*Primary Examiner*—Andres Kashnikow
*Attorney, Agent, or Firm*—Dowrey & Cross

[57] ABSTRACT

An ultra high pressure water jet cutting nozzle is disclosed which comprises a lightweight poppet valve assembly coupled by a lost motion connection to a valve actuator. The poppet valve assembly seals directly to the jet-forming element of the nozzle insuring continuous high pressure fluid in the system at all times. The maintenance of constant high fluid pressure in the system protects the supply tubing of the system against damage due to pressure waves generated by repeated opening and closing of the valve assembly. The maintenance of continuous high fluid pressure also prevents dislodgement of the jet-forming element of the nozzle.

17 Claims, 3 Drawing Figures

21
23
24
26
27
28
31
32
33
34
35
36
37
38
39
40

HIGH PRESSURE CUTTING NOZZLE WITH ON-OFF CAPABILITY

BACKGROUND OF THE INVENTION

This invention relates to an improved high pressure nozzle with on-off capability. The invention is herein described by reference to preferred embodiments thereof; however, it will be recognized that certain modifications and changes may be made therein with respect to details without departing from the essential features of the invention.

A valve is required in jet cutting systems for controlling the discharge of the water jet and flow of the fluid which may have a pressure as high as 60,000 psi or more. In conventional apparatus the valve is installed in the supply tube upstream of the cutting nozzle. Each time the valve opens or closes the supply tube between the valve and jet forming element is subjected to a pressure change equal to the maximum operating pressure.

In conventional apparatus, when the valve is rapidly opened, a compression wave is formed that propagates toward the jet forming element. Simultaneously with the formation of the pressure waves an expansion wave is formed at the valve which propagates toward the source of the high pressure. The waves thus formed upon the opening of the valve reflect off various portions of the apparatus, causing fluctuating pressures in the supply tubes. If the fatigue resistance of the supply tube is not sufficient to withstand the fluctuating pressure, rupture of the tube and danger to the operator may result. In cutting apparatus the supply tubes are, therefore, normally made of substantial thickness and strength to withstand the pressure fluctuations. Even with such thick wall supply tubes there is a possibility of metal fatigue caused by repeated passage of the waves generated by valve operation. The pressure waves generated are especially severe when a large chamber is positioned immediately upstream of the jet-forming element as is often the case when a high quality cutting jet is required.

Current liquid jet cutting apparatus systems commonly use a synthetic saphire jewel with an axial orifice as the jet-forming element to promote long life under the high jet speeds used. The jewel is normally mounted in the nozzle by an elastomeric washer to provide a resilient mounting. With conventional valving systems the alternate pressurization and depressurization of the system and resultant pressure waves may cause the jewel jet-forming element to become dislocated or dislodged from its mounting. When the jewel jet-forming element is dislocated or dislodged, disassembly of the apparatus is required to reinsert the jewel.

One approach to pressure wave associated fatigue has been to insert a hydraulic accumulator in the tube supplying the valve. The accumulator reduces the magnitude of the pressure waves passing through the supply tubing upstream of the valve, but is of little or no help for the tubing downstream of the valve. The insertion of an accumulator adds to the expense and weight of the system, however, and cannot be used in all situations. Accordingly, a need has arisen for an alternative means for preventing generation of pressure waves due to valve opening and closing.

BRIEF DESCRIPTION OF THE INVENTION

The present invention comprises an improved nozzle with on-off capability. A poppet valve element on a carrier is coupled to a valve actuator through a lost motion connector. The poppet valve element seals directly to the jewel jet-forming element. The connection means is supported by a plurality of circumferentially located tubular members which also serve to straighten swirl in the flow of fluid toward the jet-forming element thereby reducing turbulence.

As a result of the above improvements, the supply tube and interior of the nozzle assembly are constantly kept at the maximum fluid pressure. Only minimal pressure waves are thus generated upon either opening or closing of the valve. The jewel jet stream forming element is thus also under constant pressure and is not subject to pressure fluctuations which might otherwise dislodge it from its elastomeric mounting. The tubular support members allow an off-axis inlet of working fluid to be used without loss of cutting jet quality.

DESCRIPTION OF THE PREFERRED EMBODIMENT

The illustrated embodiment of the invention includes an actuator subassembly, a nozzle subassembly, a poppet subassembly, and a seal. The actuator subassembly illustrated is a pneumatic actuator, although a hydraulic or an electrical actuator could also be used, as could a simple screw or other mechanical activation system. The choice of actuator system design in all cases should take into consideration such relevant design parameters as forces to be exerted and the type of stroke needed. The actuator illustrated in FIG. 1 is designed for at least 200 pounds force with an adjustable stroke and is capable of repeated duty.

Figure 1:
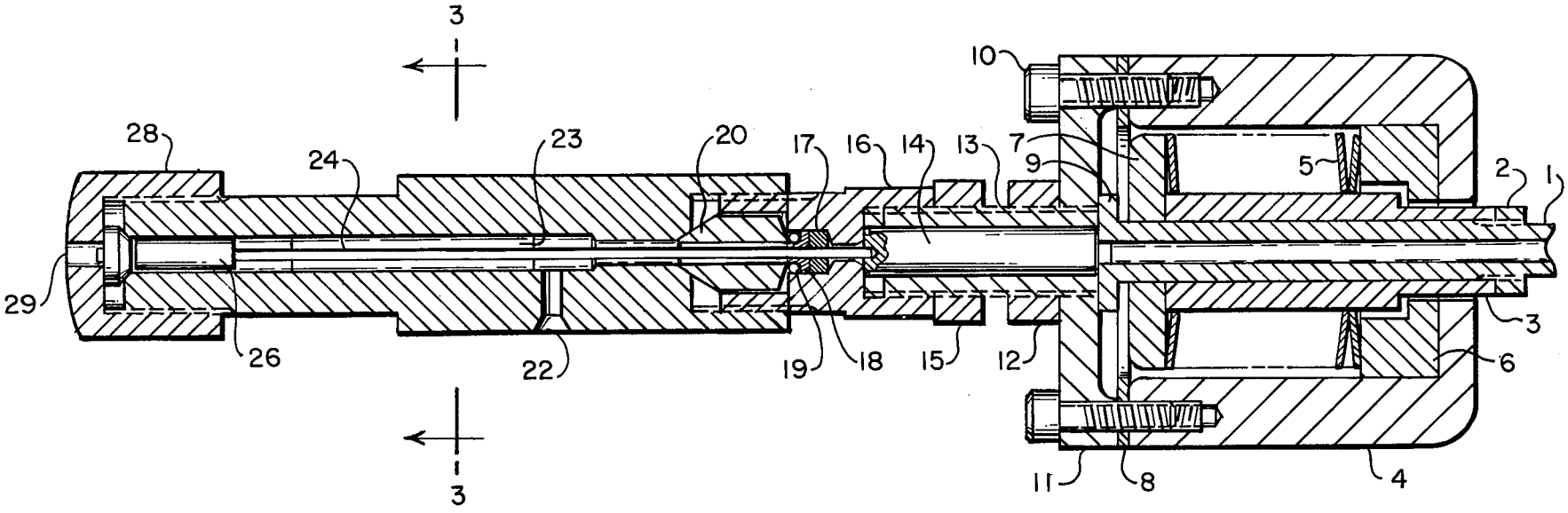
FIG. 1 is a partially sectioned longitudinal view of the valve, valve actuator and nozzle of the present invention.

Referring to FIG. 1, a hollow air stem and pressure supply conduit 1 is connected to a source of compressed air (not shown) for controlling valve operation. The coupling to the air pressure source should, of course, be flexible to allow for axial movement of air stem 1. Air stem 1 is provided with an adjustable screw threaded hex nut 2 which serves to fix the stem within a spring guide 3. The spring guide 3 is mounted within the actuator housing 4 and passes through a suitable opening in the closed end thereof as illustrated in FIG. 1. The guide includes a reduced diameter portion which extends through the end of the housing with sufficient clearance to permit limited axial travel. A spring 5 is located in the housing 4 and surrounds the guide 3. Spring 5 seats on a stop member 6 and bears against a plate 7 mounted on the stem 1. In the embodiment illustrated, spring 6 is comprised of 16 bellville springs preloaded by 0.238 inches to a force of 190 pounds. An additional 0.06 inches of deflection to the open position gives a load of 230 pounds. Other equivalent spring systems could be substituted for the springs of this embodiment. The plate 7 is fixed on the stem 1 by means of the hex nut 2 which clamps the plate and a diaphragm member 8 against a suitable shoulder 9 on the end of the air stem. The diaphragm is also clamped around its outer periphery to the housing 4 by means of a plurality of cap screws 10 which mount actuator cover 11 to the housing. As illustrated, the stop member 6 provides a shoulder which cooperates with the body of the air stem 1 to limit axial travel of the air stem 1.

A connecting tube 13 is threadably engaged in the actuator cover 11. The position of a connecting tube 13 within the seal housing 16 is adjustable for the purpose of controlling the stroke of the actuator subassembly. When axial adjustment of connecting tube 13 is completed, jam nut 15 is tightened against the actuator seal housing 16 to fix the tube position. An axially slidable dowel pin 14 is located within the connecting tube 13 and serves to transfer motion from the actuator subassembly to the poppet subassembly. The right end of dowel pin 14 as viewed in FIG. 1 is drilled to accept a stem 24 and to provide support thereto. Connecting tube 13 is also threadably connected to actuator cover 11 and is prevented from moving relative to actuator cover 11 by a second jam nut 12.

In operation the nozzle is normally in the off or closed position until it is ready for use. The poppet subassembly is held in the normal closed position by the force of spring 5 and is opened by application of air pressure. This mode of operation provides a safety feature to prevent the emission of a cutting jet in the event of failure of air pressure. When the operator desires to operate the cutting jet, air pressure is applied to air stem 1. The air passes through air stem 1 and forces diaphragm 8 in the direction of stop 6. The force on the diaphragm is transferred to plate 7, compressing spring 5 between stop 6 and plate 7. When spring 5 is in the compressed position, dowel pin 14 is free to move in the direction of stop 6 and is forced to do so as a result of the working fluid pressure in the nozzle housing 21 acting on the stem 24 in opposition to the air pressure.

In order to prevent the high pressure present in nozzle housing 21 from reaching the actuator subassembly, a seal 18 is provided between the nozzle subassembly and actuator subassembly. The seal 18 must be able to withstand a pressure differential on the order of 60,000 pounds per square inch and allow passage of a stem 24 to control the operation of the poppet subassembly. As illustrated in FIG. 1, the seal 18 is carried in the cylindrical seal housing 16, which is threadably attached to nozzle housing 21 as previously described. The seal member 18 and an O-ring 19 are held in operative position by seal backup 17, which abuts seal 18 and the interior of seal housing 16. A spacer member 20 holds the seal and O-ring in place, and spacer member 20 is held in place by the nozzle housing 21. Stem 24 passes through spacer member 20, seal 18, O-ring 19 and seal backup 17. Seal 18 serves to pressure-seal both housing 16 and stem 24 so as to isolate the high pressure fluid on the nozzle side of the seal 18.

The nozzle subassembly is housed within nozzle housing 21, which may have a hollow cylindrical shape. In the embodiment illustrated, the housing 21 is attached to the housing 16 by means of threads on the interior of the seal end of housing 21 as described and includes a beveled surface to match the bevel of spacer 20. The other end of housing 21 is adapted for attachment of a cap 28 which mounts the jewel holder 27 in a sealing relationship with nozzle housing 21.

Figures 2, 3:
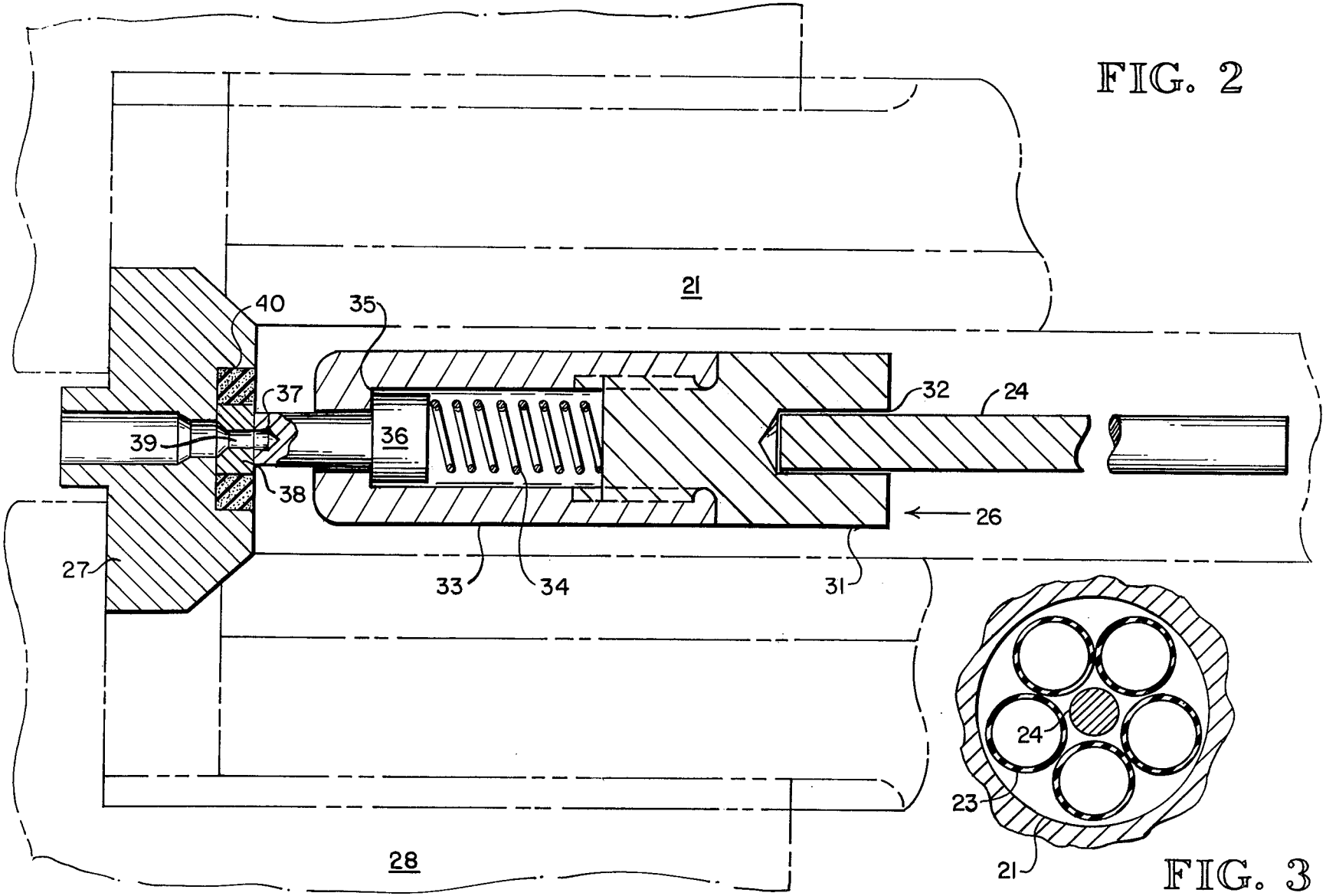
FIG. 2 is a sectional detail of the valve and nozzle of FIG. 1.
FIG. 3 is a cross sectional view taken along line 3—3 of FIG. 1.

A plurality of spacer tubes 23 and poppet subassembly 26 are located within the housing 21. The spatial relationships of spacer tubes 23, stem 24 and nozzle housing 21 are illustrated in FIG. 3, which is a sectional side view taken along line 3—3 in FIG. 1. In this embodiment five spacer tubes 23 are situated in the interior of nozzle housing 21 surrounding stem 24. Spacer tubes 23 serve to support stem 24 in the center of housing 21 and aid in preventing swirl in the working fluid.

Referring to FIGS. 1 and 2, the high pressure working fluid, which may be supplied by a high pressure pump or hydraulic intensifier (not shown), enters the interior of nozzle housing 21 through inlet 22. Connection of supply lines to inlet 22 may be made by conventional high pressure sealing means. The working fluid flows through the interior of nozzle housing 21 through and around spacer tubes 23 and stem 24. The honeycomb configuration of spacer tubes 23 helps to reduce the swirl introduced by the side positioning of inlet 22. The working fluid then flows about the poppet subassembly 26 to the orifice in the jewel 38 mounted by jewel holder 27 and, with the poppet open, emerges as a cutting jet 29. This nozzle configuration has been found satisfactory with fluid pressures as high as 60,000 pounds per square inch and can produce a cutting jet having a velocity of over 3,000 feet per second. The intrusion or positioning of the poppet subassembly 26 into the flow path of fluid does not significantly affect the quality of the cutting jet 29.

The structural details of the poppet subassembly is shown in detail in FIG. 2. As previously described, the poppet subassembly 26 is connected to the actuator subassembly by stem 24, which is supported by spacer tubes 23 and the seal assembly 17–19. A stem end member 31 is attached to the poppet end of stem 24. In this embodiment the attachment of stem end 31 to stem 24 is by means of a silver-soldered joint 32, but other equivalent joining methods could be substituted. A poppet housing 33 is threadably connected to stem end 31 and is preferably sealed with epoxy or other suitable cement or glue. Poppet housing 33 is a hollow cylindrical member with a shoulder 35 on the inside surface of its free end, which is normally in proximity to the jewel jet-forming element 38. A spring 34 and a plunger 36 are located in the housing 33 with the spring 34 being positioned to provide a bias between stem end 31 and plunger 36. The spring exerts a force, pressing plunger 36 against shoulder 35 of poppet housing 33, which serves to keep the poppet extended and ready to engage the jewel. Plunger 35 is in the shape of a stepped cylinder provided with a small diameter bore 37 in its sealing face which insures that a substantial area of the face is vented to low pressure even when a small diameter nozzle opening is used. In the closed position, plunger 35 is forced against jewel jet-forming element 38 to form a seal; and, as a consequence of the bore 37, the seating stresses in the remainder of the valve face are large enough to effect a good seal. Jewel jet-forming element 38 comprises a disc having a central orifice 39 for defining and forming a cutting jet and is held in jewel holder 27 by an elastomeric washer 40. It will also be noted at this point that the diameter of the stem 24 should be as small as possible, but the cross-sectional area thereof should be larger than the seating area between the poppet and the jewel to insure that the valve will open by itself when the closing force is removed from the stem.

The poppet subassembly 26 described functions as a lost motion coupling mechanism. When air pressure is introduced into the actuator subassembly to relieve the spring pressure, the working fluid pressure in housing 21 presses the poppet subassembly 26 away from jewel jet-forming element 38, allowing the working fluid to flow through orifice 39 to form a cutting jet. When the operator desires to deactivate the cutting jet, air pressure is removed from the actuator subassembly; and spring 5 of the actuator subassembly acts through stem 24 to move poppet subassembly 26 towards jewel jet-forming element 38. Plunger 36 contacts jewel jet-forming element 38 forming a seal thereto. As previously mentioned, at the high pressures involved in the operation of this device, the metal of plunger 36 is deformed sufficiently by the difference in pressure between the interior of nozzle housing 21 and the exterior to form a satisfactory seal. The bore 37 thus aids in the formation of the seal by venting that area of plunger 36 to atmosphere.

The lost motion coupling mechanism of plunger subassembly 26 serves to isolate the jewel jet-forming element 38 from the very large forces applied through stem 24 by the actuator subassembly. Without the use of the lost motion coupling apparatus, these forces could result in the fracture of jewel jet-forming element 38. The sealing force obtained results from the difference in pressure between the interior of nozzle housing 21 and ambient pressure, rather than from the force provided by spring 34, which merely serves to keep plunger 36 extended at all times. The force that opens the valve is also provided by the difference in pressure between the interior of nozzle subassembly 21 and ambient pressure, which tends to force stem 24 from the interior of nozzle housing 21, thus, opening the valve. The force on jewel element 38 is continuous whether poppet subassembly 26 is in the open or closed position; and as a result, jewel jet-forming element 38 exhibits no tendency to work loose from jewel mounting 27.

Having thus described the preferred embodiment of the invention, it should be understood that the inventive concept may be practiced in varying equivalent forms and applications within the intended scope of the appended claims.

What is claimed is:

1. A high velocity liquid jet cutting nozzle comprising;

a housing having an inlet means for admitting high pressure working liquid thereto, outlet means in said housing for said high pressure liquid, jet forming means for forming a cutting jet of said liquid, means mounting said jet forming means in said outlet means, poppet means in said housing movable into sealing engagement with said jet forming means for controlling liquid flow through said jet forming means, poppet actuation means for moving said poppet means into and out of sealing engagement with said jet forming means.

2. The jet cutting nozzle according to claim 1 wherein;

said inlet means is positioned so as to admit liquid into said housing along a flow path generally normal to the longitudinal axis thereof, and a plurality of elongated tubes located in said housing substantially parallel to the longitudinal axis thereof for decreasing the swirl tendency of the working liquid.

3. The jet cutting nozzle according to claim 2 wherein said poppet means includes movable plunger means having a sealing face for contact with said jet forming means, and further including spring biased lost motion connecting means between said poppet actuation means and said plunger means for preventing transfer of large forces from said poppet actuation means to said jet forming means.

4. The jet cutting nozzle according to claim 3 wherein said lost motion connecting means includes;

an elongated stem operatively connected to said poppet actuation means, and spring means acting between said stem and said plunger means, said stem being surrounded by said elongated tubes and guided for axial movement thereby.

5. A high velocity liquid jet cutting nozzle as in claim 1 further including:

a seal between said housing and said poppet actuation means for preventing high pressure working liquid from reaching said poppet actuation means.

6. A high velocity liquid jet cutting nozzle as in claim 4 wherein said poppet actuation means includes spring means acting against said stem for maintaining said poppet means in the closed position, and a fluid pressure means for releasing said spring means.

7. The jet cutting nozzle according to claim 6 wherein:

said plunger means is subjected to the high pressure working liquid in said housing whereby closing of said poppet means is aided by the working liquid pressure, and said stem is subjected to the high pressure working liquid in said housing whereby movement of said stem is aided by the working liquid pressure when said fluid pressure means is actuated to open said poppet means.

8. The jet cutting nozzle according to claim 3 wherein said jet forming means comprises an orifice communicating with atmosphere and said sealing face is provided with a bore therein concentric with said orifice for increasing the area thereof vented to atmosphere.

9. The jet cutting nozzle according to claim 1 wherein said poppet means includes movable plunger means having a sealing face for contact with said jet forming means, and further including spring biased lost motion connecting means between said poppet actuation means and said plunger means for preventing transfer of large forces from said poppet actuation means to said jet forming means.

10. A high velocity liquid jet cutting nozzle comprising:

a housing having an inlet and an outlet for a high pressure working liquid, said outlet including jet forming means for forming a jet of said liquid, valve means contained in said housing means for forming a seal with said jet forming means to control flow of said liquid through said jet forming means, and actuation means for operating said valve means.

11. The nozzle of claim 10 wherein said valve means includes a plunger having a sealing face for contacting said jet forming means to form a seal therewith and wherein said actuation means includes lost motion connection means for moving the plunger out of sealing engagement with said jet forming means while preventing the application of substantial force by said plunger to said jet forming means.

12. The nozzle of claim 11 wherein said lost motion connection means includes force application means for applying force to said plunger in a direction away from said jet forming means and resilient means for biasing said plunger into engagement with said force application means.

13. The nozzle of claim 12 wherein the actuator means includes shaft means for transmitting a force to move the plunger out of contact with the jet forming means, said shaft means having a cross-sectional area greater than that of the sealing face of the plunger, whereby opening of said valve means is assisted by the presence of a high pressure liquid in said housing.

14. The nozzle of claim 13 further including means for forming a plurality of channels between the inlet and outlet for reducing turbulence in the high pressure liquid.

15. The nozzle of claim 14 wherein said shaft means extends axially through said housing and wherein said plurality of channels is formed by a plurality of tubes aligned parallel with and serving as a guide for the shaft means to move the plunger into engagement with the jet forming means.

16. The nozzle of claim 13 wherein said actuation means includes spring means for biasing said valve means into a closed position and means for releasing the pressure applied by the spring means to the valve means.

17. The nozzle of claim 12 wherein said jet forming means includes an orifice in the sealing face thereof which communicates with an area of low pressure and wherein said plunger includes a recess in its sealing face which communicates with the orifice in the jet forming means when the plunger and the jet forming means are engaged to form a seal for increasing the area of the plunger which is exposed to low pressure when the plunger is sealed with the jet forming means.

* * * * *